United States Patent [19]

Conner et al.

[11] Patent Number: 5,070,940

[45] Date of Patent: Dec. 10, 1991

[54] APPARATUS FOR DEPLOYING AND ENERGIZING SUBMERSIBLE ELECTRIC MOTOR DOWNHOLE

[75] Inventors: Stephen E. Conner, Ramona; Jeffrey L. Dwiggins; Earl B. Brookbank, both of Bartlesville, all of Okla.

[73] Assignee: Camco, Incorporated, Houston, Tex.

[21] Appl. No.: 563,181

[22] Filed: Aug. 6, 1990

[51] Int. Cl.[5] ..... E21B 47/00; H01R 4/60

[52] U.S. Cl. ..... 166/65.1; 166/66.4; 166/105; 439/191

[58] Field of Search ..... 166/66.1, 66.4, 105; 175/104; 439/191

[56] References Cited

U.S. PATENT DOCUMENTS

| | | | |
|---|---|---|---|
| 2,187,007 | 1/1940 | Barnes | 24/115 |
| 2,643,095 | 6/1953 | Arutunoff | 255/4.8 |
| 3,072,021 | 1/1963 | Marcon | 89/1.7 |
| 3,518,613 | 6/1970 | Alpert | 339/45 |
| 3,887,257 | 6/1975 | Panek et al. | 339/45 |
| 4,685,516 | 8/1987 | Smith et al. | 166/65.1 |
| 4,706,744 | 11/1987 | Smith et al. | 166/65.1 |
| 4,736,797 | 4/1988 | Restarick, Jr. et al. | 166/301 |
| 4,749,341 | 6/1988 | Bayh, III | 417/360 |
| 4,767,349 | 8/1988 | Pottier et al. | 439/191 |
| 4,913,239 | 4/1990 | Bayh, III | 166/385 |

*Primary Examiner*—William P. Neuder

[57] ABSTRACT

Apparatus for deploying and energizing pumping apparatus including a submergible electric motor comprises a cable socket assembly and a cable connecting-and-sealing chamber assembly. The cable socket assembly has a housing that is connected at a lower end to an upper end of a housing of the cable connecting-and-sealing chamber assembly, the lower end of which is connected to a housing of the motor. The upper end of the housing of the cable socket assembly has an attachment portion provided with a breakaway connection to a weight-bearing cable. An electrical cable extends through the housing of the cable socket assembly to the housing of the cable connecting-and-sealing chamber assembly, which is divided by the body of a penetrator into upper and lower chambers. Sets of conductors in the chambers are connected, respectively, to the electrical cable and to the motor, and are interconnected with each other via feed-through elements (mandrels) associated with the body. The chambers are filled with fluid that excludes well fluid. If the pumping apparatus becomes stuck downhole, the cables may be disconnected from the pumping apparatus and pulled from the well. Then the pumping apparatus may be retrieved without exposing the interior of the motor to well fluid.

16 Claims, 4 Drawing Sheets

APPARATUS FOR DEPLOYING AND ENERGIZING SUBMERSIBLE ELECTRIC MOTOR DOWNHOLE

BACKGROUND OF THE INVENTION

This invention is concerned with the deployment and energization of submergible electric motors downhole.

In cable deployed pumping systems (sometimes referred to as cable suspended pumping systems), downhole pumping apparatus (including a submergible pump driven by an oil-filled submergible electric motor, and other components) is lowered into a well on a weight-bearing (strength) cable and is energized by an electrical cable. The cables may be separate cable structures that are banded together or may be components of a single cable structure. The pumping apparatus is lowered onto a landing device previously installed in the well and is releasably locked thereto.

Occasions arise when it becomes necessary to pull the pumping apparatus from the well. This is normally performed by means of the weight-bearing cable. Sometimes, however, the pumping apparatus becomes lodged in the well, i.e., stuck downhole, and it cannot be pulled from the well via the cable.

Excessive pulling loads applied to a cable cause damage to the cable as well as to components of the pumping apparatus. Moreover, forced detachment of a cable from stuck pumping apparatus frequently allows well fluid to enter the interior of the motor, so that when the pumping apparatus is later retrieved, damage to the motor due to the entry of well fluid must be repaired, or the motor must be replaced, before the well can be made productive again.

BRIEF DESCRIPTION OF THE INVENTION

The present invention provides a solution to the foregoing problem. First, apparatus in accordance with the invention comprises a novel cable ("rope") socket assembly having a breakaway connection that permits a weight-bearing cable to be withdrawn from a well without damage to the cable or to the pumping apparatus. Second apparatus in accordance with the invention comprises a cable connecting-and-sealing chamber assembly for connecting an electrical cable to a submergible motor in a manner that excludes well fluid from the interior of the motor and that prevents the entry of well fluid if the cable is unplugged and withdrawn from the well separately from the motor. When the pumping apparatus is later retrieved, the motor is intact, greatly simplifying any necessary repair.

BRIEF DESCRIPTION OF THE DRAWINGS

The invention will be further described in connection with the accompanying drawings, wherein.

DETAILED DESCRIPTION OF PREFERRED EMBODIMENTS

Figure 1:
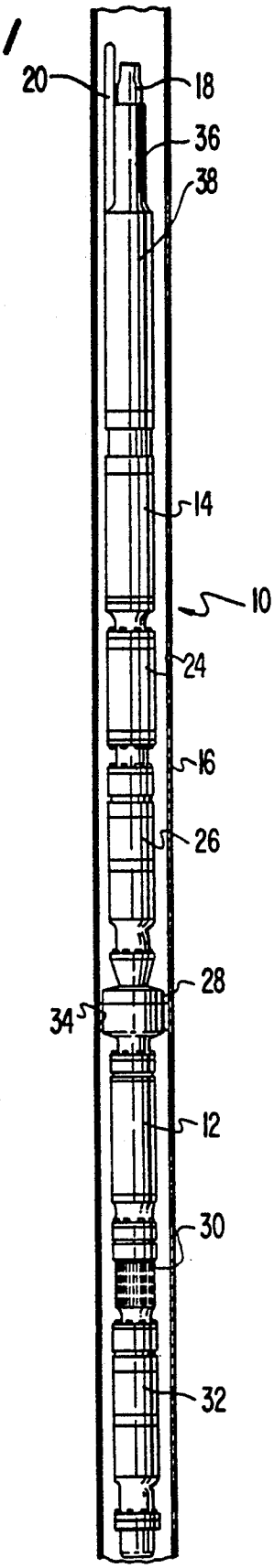
FIG. 1 is a diagrammatic partly sectional elevation view illustrating the general arrangement of downhole pumping, apparatus in accordance with the invention.

The general arrangement of downhole pumping apparatus, including apparatus in accordance with the invention, is shown in FIG. 1. The pumping apparatus 10 comprises a submergible pump 12 driven by a submergible electric motor 14 and deployed in a well 16 by means of a cable. In the embodiment illustrated, separate weight-bearing and electrical cables 18 and 20, banded together by bands 22, are used. See FIG. 2. The pumping apparatus may also comprise a universal motor base 24, a protector 26, a pump discharge head and lock-down assembly 28, a pump intake section 30, and a thrust bearing section 32. The pumping apparatus is shown seated on a shoe 34 previously installed in the well. The shoe may be part of a liner. Prior art cable deployed pumping apparatus is shown, for example, in U.S. Pat. Nos. 3,411,454; 3,424,485; 3,468,258; 3,672,795; 3,853,430; 4,171,934; and 4,352,394, all assigned to the assignee of the present invention. In accordance with the invention, the downhole pumping apparatus also comprises a novel cable socket assembly 36 and a novel connecting-and-sealing chamber assembly 38 arranged seriatim between the lower end of the weight-bearing cable 18 and the upper end of the motor 14.

Figure 2:
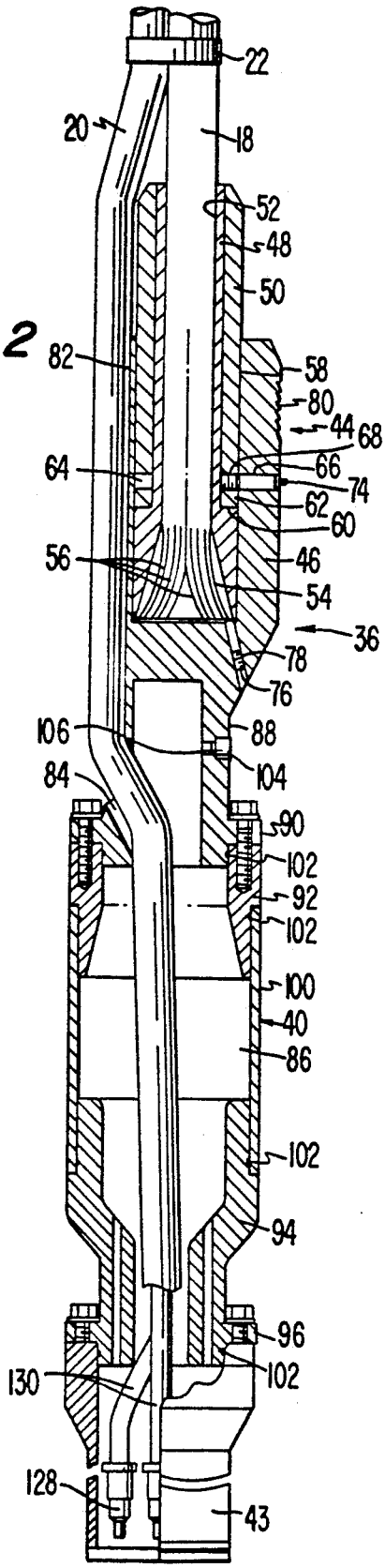
FIG. 2 is a longitudinal sectional view of a cable socket assembly in accordance with the invention.
Figure 2A:
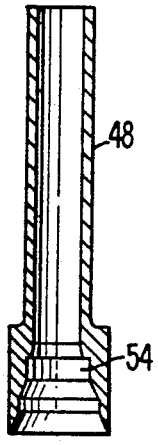
FIG. 2A is a longitudinal sectional view of a preferred form of a component of the cable socket assembly.
Figure 3:
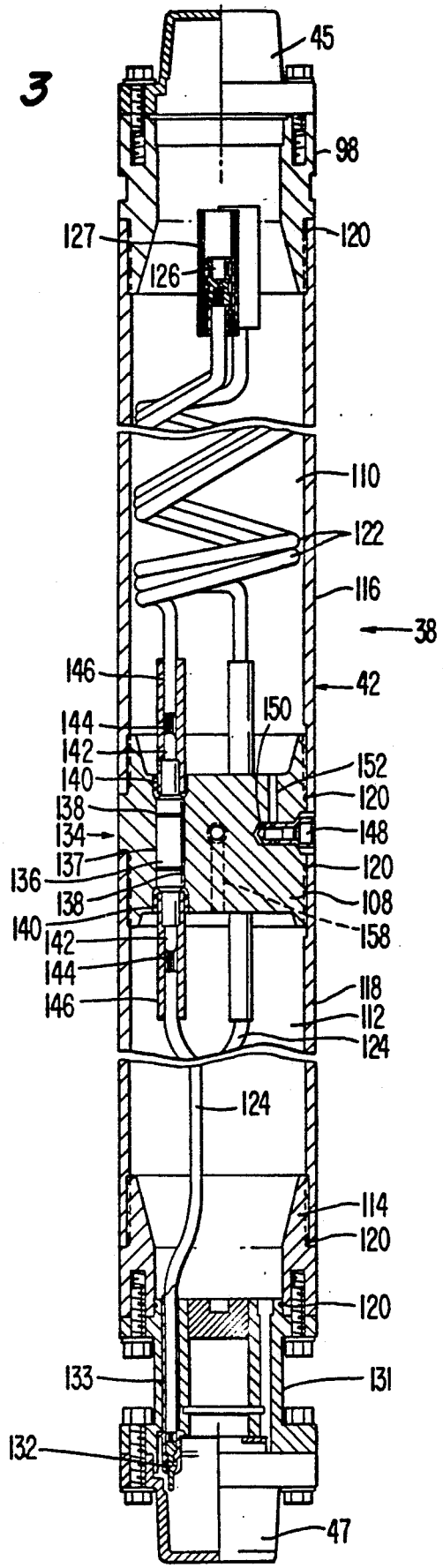
FIG. 3 is a longitudinal sectional view of a cable connecting-and-sealing chamber assembly in accordance with the invention.

As shown in FIGS. 2 and 3, each of the assemblies 36 and 38 has an outer housing 40 or 42. The lower end of the housing 40 of the cable socket assembly (shown closed by a temporary shipping cover 43) is bolted (or otherwise attached) to the upper end of the housing 42 of the connecting-and-sealing assembly (shown closed by a temporary shipping cover 45), the lower end of which (shown closed by a temporary shipping cover 47) is bolted (or otherwise attached) to the upper end of the housing of the motor. The upper end of the housing 40 is bolted (or otherwise attached) to the lower end of an attachment portion 44 of the cable socket assembly. The attachment portion includes an outer member 46, an inner member 48, and an intermediate member 50. The weight-bearing cable 18 extends through a longitudinal passage 52 of the inner member and terminates in a laterally expanded tapered end portion 54 of the passage. The tapered end portion preferably has a stepped configuration, as shown in FIG. 2A. The lower end of the weight-bearing cable is anchored in the inner member in a manner which will now be described.

After the intermediate member 50 has been telescoped with the inner member 48, the weight-bearing cable 18 is passed through the passage 52 of the inner member and beyond the open extremity of the tapered end portion 54. End portions of the wires 56 that make up the weight-bearing cable are exposed, separated, and bent back (after heating with an acetylene torch). Then the inner and intermediate members are moved relative to the weight-bearing cable so that the end portions of the wires are located in the tapered end portion of the passage 52. With the inner and intermediate members oriented vertically so that the open extremity of the tapered end portion 54 is at the top, and after preheating of the part of the inner member surrounding the tapered end portion, heated and liquefied 397 silver Babbitt metal is poured into the open extremity until the tapered end portion is completely filled (oakum having been placed in the bottom of the tapered end portion to prevent seepage). An appropriate silver Babbitt metal composition sold by ABEX Corporation, Engineering Products Division, Meadville, Pa., consists of 83.0 to 85.5% lead; 9.0 to 11.0% antimony; 2.5 to 4.0% tin; 1.5 to 2.5% silver; less than 0.5% copper; less than 0.3% arsenic; less than 0.1% iron; less than 0.1% bismuth; less than 0.005% zinc; less than 0.005% aluminum; less than 0.05% cadmium; and insignificant amounts of other materials totalling less than 0.2%. When the Babbitt metal cools, the weight-bearing cable 18 is securely anchored to the inner member 48.

The outer member 46 has a well 58 that receives the inner member 48 and the intermediate member 50. The inner member has a shoulder 60 that engages an end 62 of the intermediate member.

Figure 4:
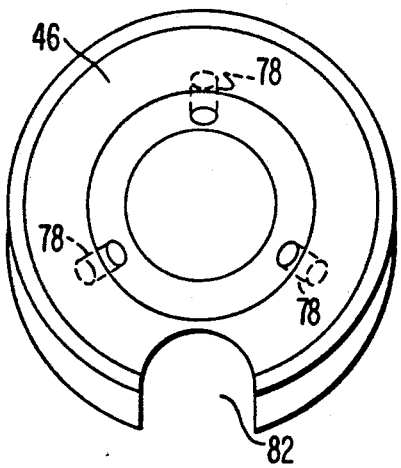
FIG. 4 is an end view of a component of the cable socket assembly.
Figure 6:
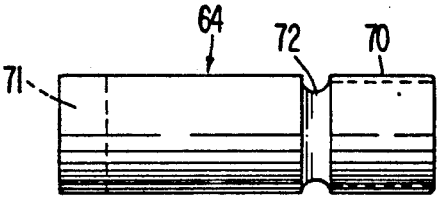
FIG. 6 is a plan view of a shear pin employed in the invention.

A breakaway connection is provided between the outer member and the intermediate member by means of a plurality (e.g., 8) of shear pins 64 (FIG. 6) inserted into corresponding equally spaced radial bores 66, 68 of the outer and intermediate members. One end 70 of each pin is threaded into the corresponding bore of the intermediate member (the opposite end of the pin having a driver slot 71). Each pin has a circumferential groove 72 positioned at the interface between the outer member and the intermediate member to provide a shear plane. A springy circular wire 74 seated in a circumferential groove and covered by banding (not shown) prevents stubs of the shear pins 64 from falling out of their bores after the pins are sheared. Several (e.g., 3) screws 76 are threaded into angulated bores 78 of the outer member (see FIG. 4) so as to engage the solidified Babbitt metal and to urge the inner member and the intermediate member to move outwardly of the well 58, thereby pre-loading the shear pins.

The outer surface of the upper end of the outer member has serrations 80 for engagement with a retrieval tool (not shown). Along one side of the outer member a passage 82 is provided, in the form of a longitudinal groove (see FIG. 4), for passing the electrical cable 20 to the housing 40 via a side entry 84. The interior of the housing provides a passage 86 for passing the electrical cable downwardly to the cable connecting-and-sealing assembly 38.

The outer member 46 tapers downwardly and inwardly to form a fishing neck 88 and has a flange 90 that is bolted (or otherwise attached) to a sleeve 92 forming the upper end of the housing 40. The lower end of the housing 40 is formed by a sleeve 94 having a flange 96 that is bolted to a sleeve 98 at the upper end of the connecting-and-sealing chamber assembly 38 (FIG. 3). A cylindrical sidewall 100 extends between the sleeves 92 and 94 and is threaded, welded, or otherwise attached thereto. O-rings 102 provide fluid seals between juxtaposed parts. A removable fill plug 104 closes a bore 106 through which fluid is admitted to the interior of the housing 40, as later described.

As shown in FIG. 3, the housing 42 of the connecting-and-sealing chamber assembly 38 is divided by a body 108 into two chambers 110, 112 that are sealed from each other. Sleeve 98 at the upper end of the housing is bolted to the lower end of the housing 40 of the cable socket assembly, as stated earlier. A sleeve 114 at the lower end of the housing is bolted to the housing of the motor. Cylindrical sidewalls 116, 118 extend between the sleeves 98, 114 and the body 108. O-ring seals 120 are provided between juxtaposed parts.

The upper chamber 110 contains a first set of insulated conductors 122, and the lower chamber 112 contains a second set of insulated conductors 124. The upper ends of the conductors of the first set have terminals 126 (e.g., female) in Teflon sleeves 127. Terminals 126 releasably connect with corresponding terminals 128 (e.g., male) at the end of insulated conductors 130 of the electrical cable (see FIG. 2). The lower ends of the set of conductors 124 in the lower chamber are supported by a terminal holder 131 bolted (or otherwise attached) to the lower end of sleeve 114. Conductors 124 extend through Teflon sleeves 133 in corresponding bores of the terminal holder and terminate in terminals 132 (e.g., male) that connect with corresponding terminals (e.g., female) of the motor (not shown).

Figure 5:
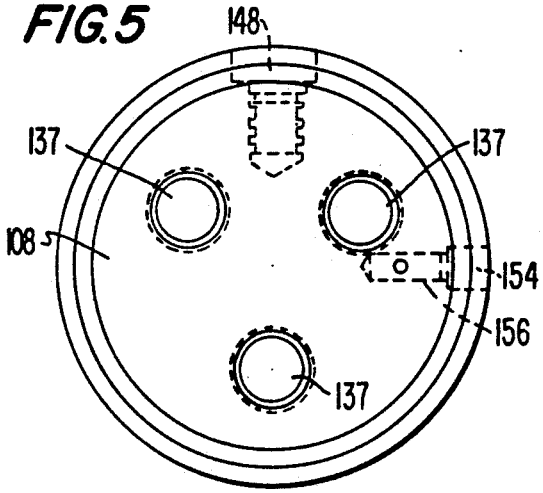
FIG. 5 is an end view of a component of the cable connecting-and-sealing chamber assembly.

The body 108 is part of a penetrator structure 134 that includes a plurality of electrical feed-through elements 136 (mandrels) sealed into bores 137 of the body by means of O-rings 138 and Teflon sleeves 140. The feed-through elements 136 provide terminals 142 (e.g., male) at opposite ends thereof that connect with terminals 144 (e.g., female) affixed to adjacent ends of the conductors 122 and 124. These terminals are surrounded by Teflon sleeves 146. A fill/drain valve and plug assembly 148 is mounted in a radial bore 150 of the body 108 communicating with a longitudinal bore 152 that is open to the upper chamber 110. A vent plug 154 (FIG. 5) is threaded into a radial bore 156 of the body 108 communicating with a longitudinal bore 158 open to the lower chamber 112. In use, the upper chamber 110, as well as the interior of the housing 40 of the cable socket assembly, is filled with a fluid such as Flourinert FC 43 or FC 40, the density of which is substantially greater than the density of well fluid, so as to exclude well fluid. Flourinert is a brand name for a fluorocarbon electronic liquid sold by 3M Company, Commercial Chemicals Division, St. Paul, Minn. The lower chamber 112 is filled with the same oil (e.g., mineral oil) that fills the interior of the motor. The body 108 is formed of a hydrolytically stable material, such as polyetheretherketone.

If the pumping apparatus 10 (FIG. 1) becomes lodged or stuck downhole, so that it cannot be pulled from the well 16 by means of the weight-bearing cable 18, the invention permits the weight-bearing cable and the electrical cable 20 to be disconnected from the pumping apparatus without damage and without permitting well fluid to enter the motor. When a pulling force of a predetermined magnitude is applied to the weight-bearing cable, the shear pins 64 break, allowing the inner and intermediate members 48 and 50 of the cable socket assembly 36 to be withdrawn from the outer member 46 together with the weight-bearing cable 18. The terminals 128 at the lower end of the electrical cable 20 merely unplug from the terminals 126 at the upper end of the conductors 122 of the upper chamber 110, so that the electrical cable may be withdrawn from the well together with the weight-bearing cable and the attached inner and intermediate members of the cable socket assembly. When this occurs, any well fluid that enters the upper chamber 110 is precluded from entering the lower chamber 112 and from entering the motor. The penetrator structure 134 comprising the body 108 and the feed-through elements 136 is capable of withstanding substantial downhole pressure differentials (60 PSI or more).

After the cables have been withdrawn from the well, the remaining downhole pumping apparatus may be retrieved by the use of a conventional retrieval tool (not shown) which engages the upper end of the outer member 46 of the cable socket assembly and applies sufficient pulling force to dislodge the downhole apparatus. Any necessary motor repairs may then be performed without the complication of motor damage due to the entry of well fluid, and the apparatus of the invention may be readily restored to its original condition, using new shear pins, of course.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. Apparatus for deploying and energizing a submergible electric motor downhole, comprising a cable socket assembly and a cable connecting-and-sealing chamber assembly adapted to be arranged seriatim in the path of cable means and the motor, said assemblies having first and second housings, respectively, means for connecting a lower end of the first housing to an upper end of the second housing, a lower end of the second housing being adapted for connection to the motor, said cable socket assembly having an attachment portion including means for attaching a weight-bearing cable of said cable means to the first housing via a breakaway connection, the first housing having a passage therein adapted to pass an electrical cable of said cable means to the second housing, the second housing being divided by a body therein into first and second chambers sealed from each other, the first chamber being adapted to communicate sealingly with said passage and the second chamber being adapted to communicate sealingly with the interior of the motor, a first set of electrical conductors in said first chamber and a second set of electrical conductors in said second chamber, said body having feed-through means for electrically interconnecting conductors of the first set with corresponding conductors of the second set, the conductors of the first set having electrical connector parts adapted to connect releasably with corresponding electrical connector parts of said electrical cable, and the conductors of said second set having electrical connector parts adapted to connect with corresponding electrical connector parts of the motor, each of said chambers being adapted to be filled with a fluid to exclude well fluid therefrom, whereby, if said breakaway connection is broken to free the weight-bearing cable from the first housing and the connection between the first set of conductors and the electrical cable is released, the second chamber and the interior of the motor will remain sealed against entry of well fluid.

2. Apparatus according to claim 1, wherein said attachment portion comprises an inner member adapted to be connected to an end of the weight-bearing cable, and an outer member fixed to said first housing, said breakaway connection being provided between said outer member and said inner member.

3. Apparatus according to claim 2, wherein said attachment portion includes an intermediate member associated with said inner member, and said breakaway connection comprises shear pin means extending through bores in said outer member and said intermediate member.

4. Apparatus according to claim 2, wherein said outer member has a longitudinal passage along one side thereof adapted to pass said electrical cable, and wherein said passage of the first housing has a side entry for admitting the electrical cable thereto.

5. Apparatus according to claim 2, wherein said attachment portion includes means for urging said inner member to move longitudinally relative to said outer member, for pre-loading said shear pin means.

6. Apparatus according to claim 2, wherein said outer member is configured for engagement with a retrieval tool.

7. A cable socket assembly for deploying and energizing a submergible electric motor downhole, comprising a housing having at one end thereof means for suspending said motor therefrom and having a cable attachment portion at the opposite end thereof, said cable attachment portion including an outer member fixed to said housing and an inner member connected to said outer member via a breakaway connection, said inner member being adapted to be fixed to an end of a weight-bearing cable, said housing having a passage therein for passing an electrical cable, wherein said attachment portion includes an intermediate member between said outer member and said inner member, said inner member having a shoulder abutting said intermediate member, and wherein said breakaway connection comprises shear pin means extending through said outer member and into said intermediate member.

8. A cable socket assembly in accordance with claim 7, further comprising means for exerting a force on said inner member tending to move said inner member longitudinally relative to said outer member for preloading said shear pin means.

9. A cable socket assembly for deploying and energizing a submergible electric motor downhole, comprising a housing having at one end thereof means for suspending said motor therefrom and having a cable attachment portion at the opposite end thereof, said cable attachment portion including an outer member fixed to said housing and an inner member connected to said outer member via a breakaway connection, said inner member being adapted to be fixed to an end of a weight-bearing cable, said housing having a passage therein for passing an electrical cable, wherein said inner member has a passage for passing said weight-bearing cable, an end portion of the last-mentioned passage being disposed within said outer member and being expanded laterally stepwise.

10. A cable connecting-and-sealing chamber assembly for detachably electrically connecting an electrical cable to a submergible electric motor downhole, comprising a housing divided into first and second chambers by a body, said chambers being sealed from each other, a first set of electrical conductors in said first chamber having electrical connector parts at one end thereof adapted to connect releasably with corresponding electrical connector parts of said cable, a second set of electrical conductors in said second chamber having at one end thereof electrical connector parts adapted to connect with corresponding electrical connector parts of the motor, feed-through means extending sealingly through said body from said first chamber to said second chamber and electrically connected to said sets of conductors at the other end of said conductors, and means for filling said chambers with a fluid adapted to exclude well fluid from said chambers.

11. Submergible pumping apparatus comprising a submergible pump driven by an oil-filled submergible electric motor and adapted to be deployed and energized downhole by cable means, said apparatus further comprising means for mechanically connecting said apparatus to a weight-bearing component of said cable means via a breakaway connection, and means for electrically connecting and disconnecting said motor with respect to an electrical component of said cable means while isolating the interior of said motor from well fluid, whereby, if the submergible pumping apparatus becomes stuck downhole, the cable means may be separated from the submergible pumping apparatus and withdrawn from a well separately from the submergible pumping apparatus.

12. A cable socket assembly for a submergible electric motor comprising a first part having means for suspending the motor therefrom, a second part having means for attaching the cable socket assembly to a weight-bearing cable component, and a breakaway connection between said first and second parts, and further comprising means for passing an electrical cable component to said motor via a housing filled with a liquid of greater density than well fluid.

13. A cable connecting-and-sealing chamber assembly for detachably electrically connecting an electrical cable to a submergible oil-filled electric motor, comprising a housing having first and second regions separated by a fluid-impervious wall, the first region communicating with the interior of the motor and the second region being sealed from the interior of the motor, and electrical connector means providing an electrical connection from said cable to said motor through said wall.

14. A cable connecting-and-sealing chamber assembly according to claim 13, wherein said first region is a chamber containing a liquid compatible with the oil in the motor and the second region is a chamber containing a different liquid.

15. A cable connecting-and-sealing chamber assembly according to claim 14, wherein said different liquid has a density substantially greater than the density of well fluid.

16. Apparatus comprising, in combination, cable means including a weight-bearing component and an electrical component, a submergible electric motor, and a cable socket assembly and a cable connecting-and-sealing chamber assembly disposed seriatim between said weight-bearing component and said motor, said cable socket assembly having means for attaching said weight-bearing component thereto via a breakaway connection, said cable connecting-and-sealing chamber assembly including a housing divided by a body into first and second chambers sealed from each other, the second chamber communicating sealingly with the interior of said motor, a first set of electrical conductors in said first chamber and a second set of electrical conductors in said second chamber, said body having feed-through means electrically interconnecting conductors of said first set with corresponding conductors of said second set, the conductors of said first set having electrical connector parts connected releasably with corresponding electrical connector parts of said electrical component, and the conductors of said second set being electrically connected with said motor, each of said chambers being filled with a fluid to exclude well fluid therefrom whereby, if said breakaway connection is broken to free the weight-bearing component, and the connection between the first set of conductors and the electrical component is released, the second chamber and the interior of the motor will remain sealed against entry of well fluid.

* * * * *